US006302529B1

(12) United States Patent
Tajima

(10) Patent No.: US 6,302,529 B1
(45) Date of Patent: Oct. 16, 2001

(54) ELECTROSTATIC INK-JET PRINTER

(75) Inventor: Osamu Tajima, Ibaraki-ken (JP)

(73) Assignee: Victor Company of Japan, Ltd., Yokohama (JP)

( * ) Notice: Subject to any disclaimer, the term of this patent is extended or adjusted under 35 U.S.C. 154(b) by 0 days.

(21) Appl. No.: 09/292,235

(22) Filed: Apr. 15, 1999

(30) Foreign Application Priority Data

Apr. 16, 1998 (JP) ..... 10-122863
Apr. 17, 1998 (JP) ..... 10-124039

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 158, 27, 10, 57; 399/271, 290, 292, 293, 294

(56) References Cited

U.S. PATENT DOCUMENTS 5,751,314 * 5/1998 Takemura et al. ..... 347/55
6,123,145 * 9/2000 Nagato et al. ..... 347/55

FOREIGN PATENT DOCUMENTS

WO 93/11866 6/1993 (JP) .
7-502218 3/1995 (JP) .
8-149253/1966 7/1996 (JP) .
9076493 3/1997 (JP) .
11300970 A * 11/1999 (JP) .
2000079682A * 3/2000 (JP) .

OTHER PUBLICATIONS

IS&T's Eifgth International Congress on Advances in Non–Impact Printing Technologies (1992) pp. 411–415 Entitled Acoustic Ink Printing, Printing by Ultrasonic Ink Ejection, Author Hadimioglu et al.

* cited by examiner

*Primary Examiner*—Raquel Yvette Gordon
(74) *Attorney, Agent, or Firm*—Anderson, Kill & Olick, P.C.

(57) ABSTRACT

An electrostatic type ink-jet printer capable of stably supplying a liquid toner and of printing characters and images without density unevenness by effectively ejecting agglomerated electrified colored particles. The electrostatic type ink-jet printer has plural jutting eject points 4, 104 made of a dielectric material orderly disposed in a plane, a liquid toner 8, 108 containing electrified colored particles P dispersed in an insulation liquid drenching surfaces of the jutting eject points, a bias electrode 13, 103 for agglomerating the electrified colored particles at the top of the jutting eject point by a Column force by a bias voltage having the same electric polarity as that of the electrified colored particles, and plural ultrasonic wave generating sections 16, 116, each provided at a base between the respective jutting eject points, for generating the ultrasonic waves travelling toward tops of the jutting eject points to separate liquid droplets containing the electrified colored particles agglomerated. Thereby, the electrified colored particles agglomerated by a bias electric field are separated by the ultrasonic wave, and characters and images are formed on the recording paper.

6 Claims, 15 Drawing Sheets

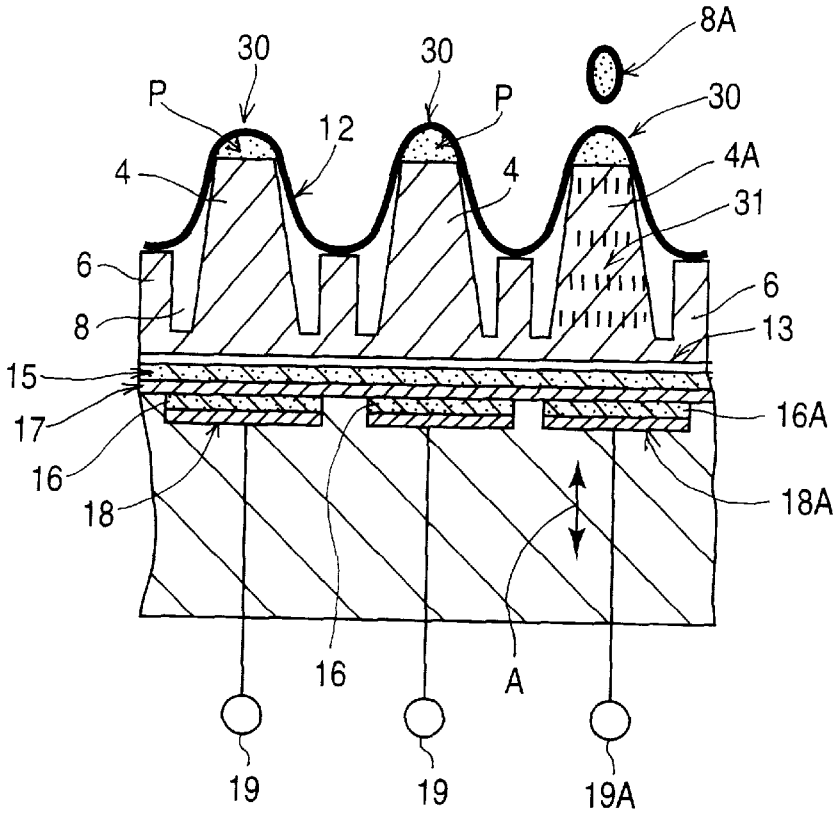
*Fig. 4*
*Fig. 5(A)*
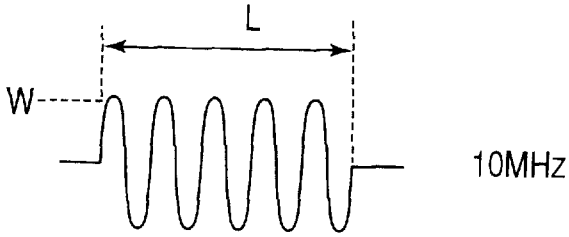
*Fig. 5(B)*
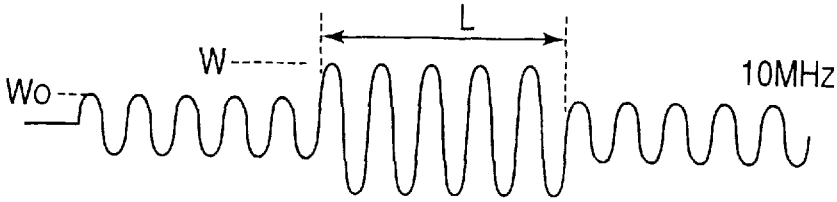

ELECTROSTATIC INK-JET PRINTER

BACKGROUND OF THE INVENTION

1. Field of the Invention

The present invention relates to an electrostatic ink-jet printer for printing characters and images on a recording medium by using a liquid toner dispersed with electrically charged and colored particles and agglomerating the electrically charged and colored particles at an end of an jutting eject point under an electrostatic force and separating droplets of the liquid toner from the top of the jutting eject point by utilizing ultrasonic vibration.

2. Description of the Related Art

Recently, as an output device of a personal computer, there are widely used ink-jet type printers for printing characters and images on a recording medium such as a recording paper by ejecting ink particles toward an opposite surface of the recording medium.

Among them, an electrostatic ink-jet printer draws much attention, which uses a liquid toner dispersed with electrically charged and colored particles (referred to as electrified colored particles hereinafter) and ejecting the electrified colored particles on a surface of a recording paper by making use of an electrostatic force.

The reason for the attention is following. In such printing apparatuses as a bubble-jet-type printer which causes ink to eject from a nozzle by making use of thermal expansion of ink and a piezo-type printer which causes ink to eject by using a piezo-pump, they require not only a nozzle which causes a chock of ink passing therethrough but also require provision of various kinds of nozzles each having a different internal diameter for printing an image in different tone (gradation). On the other hand, the electrostatic ink-jet printer does not require any nozzles. In addition, a formation of the tone is easily realized by only changing a width or a height of a pulse of a voltage to be applied.

These electrostatic type printers are disclosed in the Japanese Patent Application 8-149253 and the Japanese Patent Publication 7-502218, wherein a liquid toner dispersed with electrified colored particles in an insulation liquid is supplied to an ejecting point of a pointed electrode body, and is ejected by a Coulomb force developed by applying a voltage having the same electric polarity as that of the electrified colored particles, resulting in printing on a recording paper.

In order to form an image, a bias voltage is always applied to an electrode to agglomerate the electrified colored particles to the ejecting point, and an ejection voltage is applied to the electrode responsive to an image input signal. This electrostatic printing method enables to realize a high density printing because the electrified colored particles are ejected after being agglomerated. In addition, the electrostatic printer has a simple structure, so that it is possible to form multi-ejecting points by aligning a plurality of electrodes in-line, resulting in a feature to allow a high speed recording.

Further, as another ink-jet printer, there is proposed a printer device utilizing an ultrasonic wave in a following English document:

[ACOUSTIC INK PRINTING: PRINTING BY ULTRASONIC INK EJECTION] (IS&T's English International Congress on Advances in Non-Impact Printing Technologies (1992), page 411–415).

In this electrostatic apparatus, an ultrasonic wave is generated from an ultrasonic generator submerged in ink.

The generated ultrasonic wave is focused on a surface of ink by using an acoustic lens. Thereby, the ink is locally vibrated, so that minute ink droplets are separated from the ink and ejected.

Incidentally, important points to stably eject the liquid toner are how to provide the liquid toner to a surface of the ejecting point and how to effectively eject the electrified colored particles. Because a variation of a supplied quantity of the liquid toner containing the electrified colored particles brings about a variation of quantity of an ejected liquid toner, resulting in an density unevenness in the printed character and image.

As far as this is concerned, a satisfactory result has not been obtained in the abovementioned printers disclosed in the Japanese Patent Application 8-149253 and the Japanese Patent Publication 7-502218.

Further, in the printer utilizing the ultrasonic wave, ink droplets are ejected by a mechanical vibration. Thus, the colored particles need not be electrified. However, in order to eject the ink droplets from a flat liquid surface of ink, it is necessary to precisely focus the ultrasonic wave on the liquid surface of ink by using a high ultrasonic frequency of 150 MHz. Therefore, a height of the liquid surface has to be precisely controlled to a degree of an order of submicron. In addition, an acoustic lens system needs a high accuracy, resulting in a great difficulty in a realization of the printer.

Furthermore, in order to eject the ink droplets from the flat level of the liquid ink surface, it is difficult to use an ink having a high viscosity. Inevitably, a dye having a low viscosity has to be used as the ink, resulting in a drawback of easily oozing out (permeating) to the paper. In other words, in order to obtain a high print quality, a pigment having a high viscosity without an ink permeation can not be used here instead of the dye.

SUMMARY OF THE INVENTION

Accordingly, a general object of the present invention is to provide an electrostatic ink-jet printer where the above disadvantages have been eliminated.

A specific object of the present invention is to provide an electrostatic ink-jet printer capable of stably providing liquid toner to the ejecting points as well as effectively ejecting electrified colored and agglomerated particles from the ejecting points, to obtain printed characters and images without density unevenness.

A more specific object of the present invention is to provide an electrostatic type ink-jet printer comprising: a plurality of jutting eject points orderly aligned on a plane; a liquid toner containing electrified colored particles for drenching surfaces of the plurality of jutting eject points; a bias electrode for generating a Column's force by being applied with a voltage having an identical electric polarity with that of the electrified colored particles so as to agglomerate the electrified colored particles to tops of the plurality of jutting eject points; and a plurality of ultrasonic wave generating sections provided at positions corresponding to bases of the plurality of jutting eject points, the plurality of ultrasonic wave generating sections generating ultrasonic waves directed toward the tops of the plurality of jutting eject points so as to separate liquid droplets containing the agglomerated electrified colored particles from the tops thereof.

Thereby, a whole surface of the respective jutting eject points is wetted by the liquid toner containing the electrified colored particles due to a capillary phenomenon, resulting in a meniscus of a thin layer having a cone shape thereon. A bias electric field is generated by applying a bias voltage having the same polarity as that of the electrified colored particles to the bias electrode so as to agglomerate the electrified colored particles to a top of the meniscus. As a surface tension exerted in the liquid toner is larger than the bias electric field, the electrified colored particles agglomerated remain on the crests of the meniscus. In this state, the ultrasonic wave is generated by applying a driving signal to the ultrasonic wave generating section. The ultrasonic wave generated travels to the top of the respective jutting eject points so as to cause a vibration of the electrified colored particles agglomerated at the crest of the meniscus, resulting in separation of the electrified colored particles from the meniscus. The electrified colored particles agglomerated at the crest of the meniscus are in an easily separable status due to the bias electric field. Thus, they are easily separated by the ultrasonic vibration. The electrified colored particles separated (liquid droplet of the liquid toner) are ejected by being accelerated in the bias electric field, and attached on the recording medium disposed in an ejecting direction, resulting in a formation of characters and images.

And the control of the electrified colored particles are performed by applying the ultrasonic wave or stopping it. As mentioned above, the separation and ejection thereof are effectively performed. Thus, it is possible to use a pigment having a high viscosity as a liquid toner, resulting in a precise print of characters or images with a high density without a smear. In this case, in order to form canals between jutting eject points to convey the liquid toner by utilizing the capillary phenomenon, there are formed lands having a height lower than that of the jutting eject points between the respective jutting eject points, so that the liquid toner flows smoothly in the canals. This enables to wet the surface of the jutting eject points sufficiently and to swiftly agglomerate the electrified colored particles, resulting in a high print quality without a printing unevenness.

Another and more specific object of the present invention is to provide an electrostatic type ink-jet printer comprising: a plurality of jutting eject points made of dielectric material orderly aligned on a plane; a liquid toner containing electrified colored particles for drenching surfaces of the plurality of jutting eject points; a bias electrode for generating a Column's force by being applied with a voltage having an identical electric polarity with that of the electrified colored particles; an plurality of ultrasonic wave generating sections provided at positions corresponding to bases of the plurality of jutting eject points, for generating ultrasonic waves directed toward tops of the plurality of jutting eject points; and an ultrasonic convergent lens for converging the ultrasonic wave generated from the plurality of jutting eject points to the tops of the plurality of jutting eject points so as to separate liquid droplets containing the agglomerated electrified colored particles from the tops thereof.

In this case, the ultrasonic convergent lens may be composed of a liquid for forming a lens provided between the ultrasonic wave generating sections and the jutting eject points and a curved surface formed in a boundary surface of the jutting eject points, or composed of a diffraction grating having a plurality of ring plates coaxially aligned.

Further, to the ultrasonic wave generating sections, there is applied a high frequency burst signal as the ultrasonic wave generating signal. The ultrasonic wave generating signal may contain a first high frequency burst section having a larger amplitude for separating the liquid droplet and a second high frequency burst section having a smaller amplitude for enhancing a flow of the electrified colored particles. In this case, flow of the electrified colored particles is enhanced, resulting in an enhancement of agglomeration of the electrified colored particles.

BRIEF DESCRIPTION OF THE DRAWINGS

FIG. 4 is a sectional view for explaining an operation of the electrostatic ink-jet printer shown in FIG. 2;

FIG. 5(A) shows a waveform of an ultrasonic wave generating signal applied to an ultrasonic wave generating section;

FIG. 5(B) shows another waveform of an ultrasonic wave generating signal applied to the ultrasonic wave generating section;

DETAILED DESCRIPTION OF THE PREFERRED EMBODIMENTS

First Embodiment

Description is given of an electrostatic ink-jet printer of a first embodiment of the present invention referring to drawings.

Figure 1:
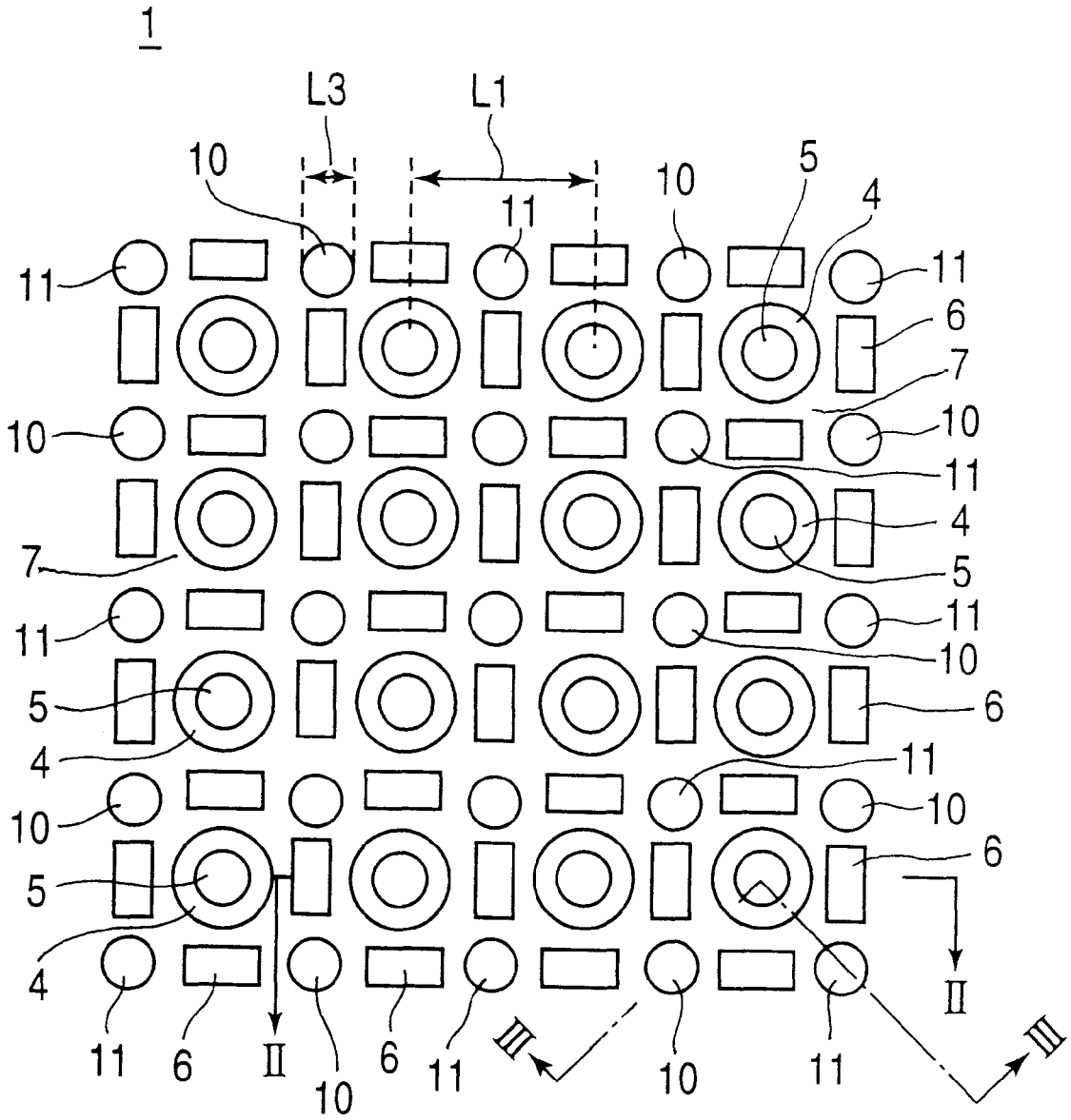
FIG. 1 is a plan view showing an electrostatic ink-jet printer of a first embodiment in the present invention.
Figure 2:
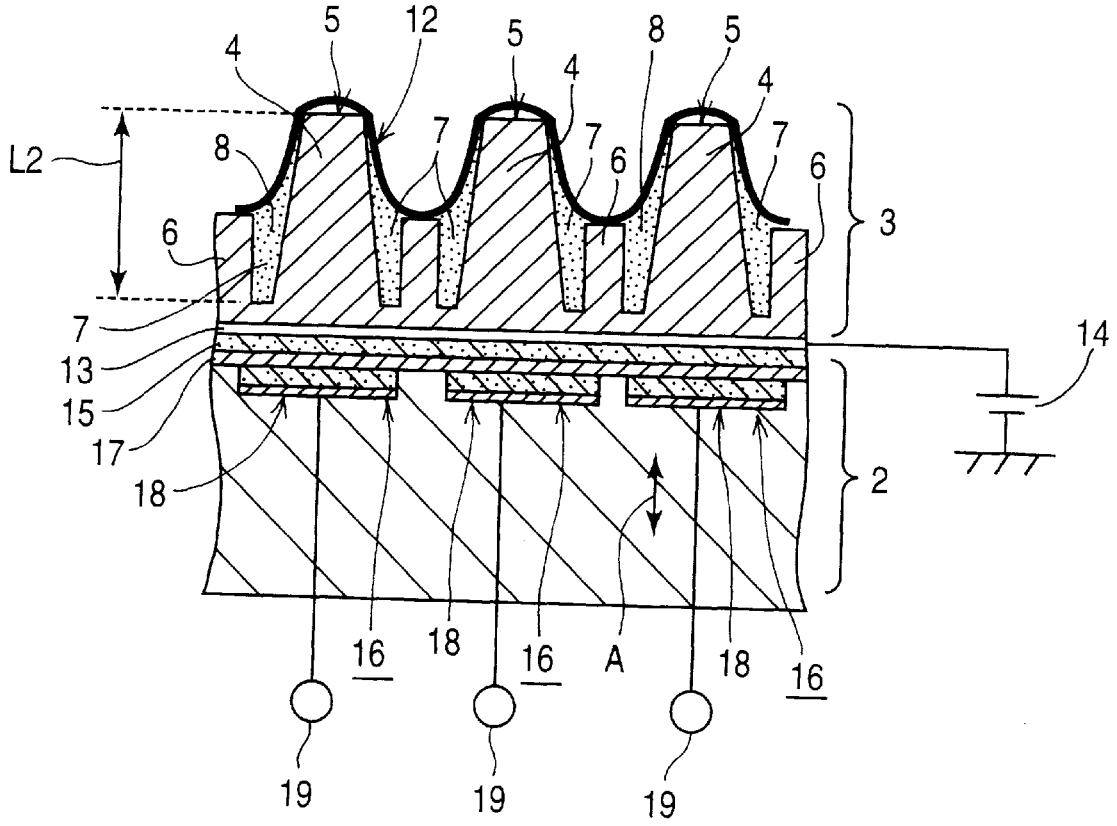
FIG. 2 is a sectional view along a II—II line shown in FIG. 1.
Figure 3:
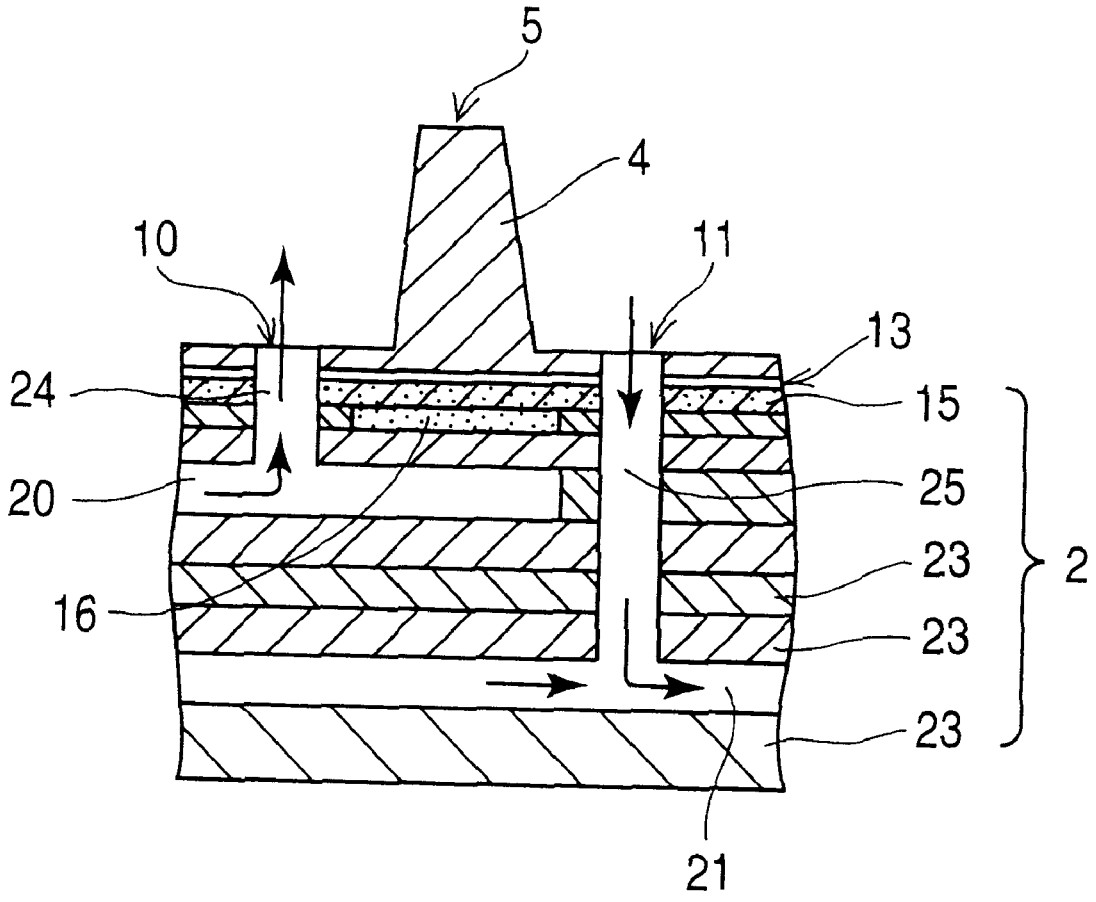
FIG. 3 is a sectional view along a III—III line shown in FIG. 1.

FIG. 1 is a plan view showing an electrostatic ink-jet printer of a first embodiment in the present invention;

FIG. 2 is a sectional view along a II—II line shown in FIG. 1;

FIG. 3 is a sectional view along a III—III line shown in FIG. 1; and FIG. 4 is a sectional view for explaining an operation of the electrostatic ink-jet printer shown in FIG. 2.

As shown in FIGS. 1 and 2, an electrostatic ink-jet printer (referred to as ink-jet printer) 1 comprises a substrate section 2 provided with various kinds of electrodes and an ejecting plate 3 connected to the substrate section 2. The ejecting plate 3 is made of a thermoplastic resin by compression molding. In the ejecting plate 3 there are orderly and crosswise aligned a plurality of jutting eject points 4 in an equal pitch. The respective jutting eject points 4 have a frustum of a cone with a flat top 5. However, the flat top 5 of the frustum of the cone may be replaced with a curved top, and the frustum of the cone may be replaced with a frustum of a pyramid.

At a center between respective jutting eject points 4, there is protrudingly provided a land 6 having a rectangular shape protruding upward from a bottom of the center so that its height is made lower than that of the respective jutting eject points 4. Around the jutting eject points 4, there are formed canals 7 having a minute ditch width. All these canals 7 are connected to each other over the whole ejecting plate 3.

In these canals 7, a liquid toner 8 dispersed with electrified colored particles in an insulation liquid such as isoparaffin is filled, and is flown through the canals 7 so as to be provided to the respective jutting eject points 4 due to a capillary phenomenon.

Further, in the ejecting plate 3, supply ports 10 for providing a liquid toner 8 over the ejecting plate 3 are aligned diagonally with respect to a criss-cross provision of the jutting eject points 4 and drain ports 11 for collecting used liquid toner 8 are aligned in another diagonal direction thereof so as to provide the liquid toner 8 evenly to the respective jutting eject points 4. When the liquid toner 8 is provided on a surface of the ejecting plate 3, a whole surface of the respective jutting eject points 4 is drenched due to the capillary phenomenon. Thus, a meniscus 12 having crests and troughs due to a surface tension is formed on the ejecting plate 3.

On the other hand, on an upper surface of the substrate section 2 interfacing to a bottom of the ejecting plate 3, there is provided a bias electrode 13 made of, for instance, a copper foil (film). To this bias electrode 13 a bias power source 14 is electrically connected so as to apply a DC voltage having the same electric polarity as that of the electrified colored particles. By applying this bias voltage, an electric field is developed upward in a drawing of FIGS. 2 and 4. Thus, due to the Coulomb force, the electrified colored particles in the liquid toner 8 are physically biased to and agglomerated on the flat top 5 of the corresponding jutting eject points 4.

And, under the bias electrode 13, there are individually provided ultrasonic wave generating sections 16 corresponding to the respective jutting eject points 4. The respective ultrasonic wave generating sections 16 are made of a piezoelectric ceramics like as PZT ($PbZrO_3$) or barium titanate. When a voltage is selectively applied to one of them, the ultrasonic wave generating section 16 vibrates mechanically at a high frequency and generates an ultrasonic wave traveling upward in a top direction A of the jutting eject point 4.

As shown in FIG. 2, the respective ultrasonic wave generating sections 16 have a common electrode 17 commonly provided on an upper surface thereof and have an individual electrode 18 on a lower surface thereof. Further, a terminal 19 is connected to the respective individual electrode 18. And when an ultrasonic wave generating signal is selectively applied to the individual electrodes 18 through the terminal 19, the electrified colored particles agglomerated on the corresponding jutting eject point 4 take off therefrom.

Further, in the substrate section 2, there are formed supply channels 20 for supplying the liquid toner 8 to the respective supply ports 10 and collection channels 21 for collecting the liquid toner 8 sucked through the respective drain ports 11 as shown in FIG. 3. The supply channels 20 lead to the respective supply ports 10 and the collection paths lead to the respective drain ports 11.

In order to produce this substrate section 2, a plurality of thin plastic substrates 23 are laminated together by thermal pressure welding as shown in FIG. 3. At necessary positions of the respective plastic substrates 23 there are provided slits for forming the supply channels 20 and the collection channels 21 and holes for forming connection channels 24, 25 connected with the supply ports 10 and the drain sink ports 11 in a vertical direction. Further, the substrate section 2 is easily produced by using a printed board where the positions to be formed with the bias electrode 13 and the common electrode 17 are print-pattern-processed.

Dimensions of respective parts in this embodiment are as follows.

A pitch L1 between the respective jutting eject points 4 is about 0.5 to 1.0 mm, a height L2 of the respective jutting eject points 4 is about 0.2 to 1.0 mm, a diameter L3 of the respective supply ports 10 or drain ports 11 is about 0.2 to 0.3 mm and a diameter of the flat top 5 of the respective jutting eject points 4 is about 10 $\mu$m. Thereby, it is possible to form an ink droplet corresponding to a minimum gradation in an image density of 600 DPI (dot per inch).

Next, a description is given of an operation of the embodiment mentioned above.

First, the liquid toner 8 is supplied to an upper surface of the ejecting plate 3 from the supply ports 10 through the supply channels 20, and is fed through the canals 7 shown in FIG. 2 caused by the capillary phenomenon, resulting in that a whole surface of the respective jutting eject points 4 is drenched. Further, used liquid toner 8 is collected from the drain ports 11 through the collection channels 21. The liquid toner 8 drenching the surface of the respective jutting eject points 4 forms the meniscus 12 having the crests and troughs shown in FIG. 2 caused by a surface tension of a toner solvent.

As shown in FIG. 2, when a voltage is not applied to the bias electrode 13, the electrified colored particles are not agglomerated to the crests of the meniscus 12. Thus, the crests of the meniscus 12 are not expanded.

And, when the bias voltage is applied to the bias electrode 13, an electric field is generated. Thereby, the electrified colored particles having the same polarity of that of the bias voltage are repelled to go away from the bias electrode 13, resulting in that the electrified colored particles P are agglomerated and the crests of the meniscus 12 are expanded as shown with a reference character 30 in FIG. 4.

Here, when an ultrasonic wave generating signal is selectively applied to an individual electrode 18A through a terminal 19A for example, an ultrasonic wave generating section 16A corresponding to the terminal 19A begins to vibrate in an arrow direction A, resulting in a generation of an ultrasonic wave 31 traveling upward to the top direction of the jutting eject point 4A.

As respective sectional areas of the jutting eject point 4A and the meniscus 12 are made to be gradually decreased toward a top direction thereof and the tops thereof are made to be free ends, an intensity of the ultrasonic vibration is gradually elevated. This vibration breaks a balance of the electrified colored particles maintained by the surface tension of the toner solvent. Thus, a liquid droplet 8A is separated from the flat top 5 of the jutting eject point 4A. As electrified, the liquid droplet 8A is ejected in an upper direction in FIG. 4 by being accelerated by the bias electric field, and attaches to a recording medium such as a paper, resulting in printed characters and images thereon.

FIG. 5(A) shows a waveform of an ultrasonic wave generating signal applied to an ultrasonic wave generating section; and FIG. 5(B) shows another waveform of an ultrasonic wave generating signal applied to the ultrasonic wave generating section.

The ultrasonic wave generating signal applied to the individual electrode 18A is exemplarily shown in FIG. 5(A), wherein a high frequency burst signal having a power W of a frequency of 10 MHz is used, and the liquid droplet 8A is generated at a high amplitude section of the waveform, and a printing density is controlled by changing a length L of the high amplitude section.

Further, the ultrasonic wave generating signal shown in FIG. 5(A) may be replaced with an ultrasonic driving signal shown in FIG. 5(B). In this case, the ultrasonic wave generating signal has two parts. One is the same as the high frequency burst signal having the power W shown in FIG. 5(A) and another is a signal having a power Wo of a smaller amplitude than that of the former. The former (signal of W) is applied to the individual electrode 18A when the liquid droplet 8A needs to be developed, otherwise, the latter (signal of Wo) is applied thereto so that the liquid droplet 8A is not developed due to the bias electric field and the surface tension. Application of smaller power Wo for the ultrasonic wave decreases frictions exerted between the electrified colored particles by releasing boundary force exerted therebetween. Thus, the mobility and agglomeration of the electrified colored particles are promoted, and the agglomeration thereof is accelerated in a time period between printing pulses, resulting in that an ink ejection interval is shorten.

As mentioned above, the ultrasonic wave is mainly used to develop the liquid droplet 8A by separating the electrified colored particles agglomerated on the jutting eject point 4, and the bias voltage is used to agglomerate the electrified colored particles dispersed in the liquid toner 8 and to eject the formed liquid droplet 8A toward the recording medium by accelerating. Thereby, it is possible to effectively form the liquid droplet 8A from the liquid toner 8, resulting in print characters and images on the recording medium.

In this case, as the liquid droplet 8A is effectively formed, the pigment having a larger viscosity than that of the dye can be used, resulting in a print image with a high quality without ink permeation into the recording medium.

Further, as the ultrasonic wave travels toward the top of the jutting eject point 4 of which sectional area is gradually decreased, high dimensional accuracy is not required in forming the ultrasonic wave generating section 16 compared with conventional ones, resulting in an easy design thereof. Furthermore, as a secondary effect of the ultrasonic wave, the ultrasonic wave vibrates the electrified colored particles in the liquid toner 8. This vibration has advantages to allow the liquid toner 8 to move easily in the canals 7 due to the capillary phenomenon and to agglomerate the electrified colored particles smoothly in the meniscus 12, resulting in an easy ejection of the liquid droplet 8A at a high frequency.

Further, by providing the lands 6, ripples developed on the liquid surface of the meniscus 12 when the liquid droplet 8A takes off, is absorbed by the lands 6, resulting in that the ripples of the liquid surface are prevented from reaching adjacent jutting eject points 4. Thus, an adverse effect such as a closs-talk is prevented from developing.

Instead of providing the lands 6, a base of the jutting eject point 4 may be made thicker. This structure allows the ultrasonic wave to effectively travel, resulting in a highly efficient ejection head.

Further, instead of providing the bias electrode 13 and the common electrode 17 individually, they can be commonly used. Thereby, it is possible to decrease interference of the ultrasonic wave to the adjacent ejecting points because the respective ultrasonic wave generating sections 16 reside closer to the respective jutting eject point 4.

Figure 6:
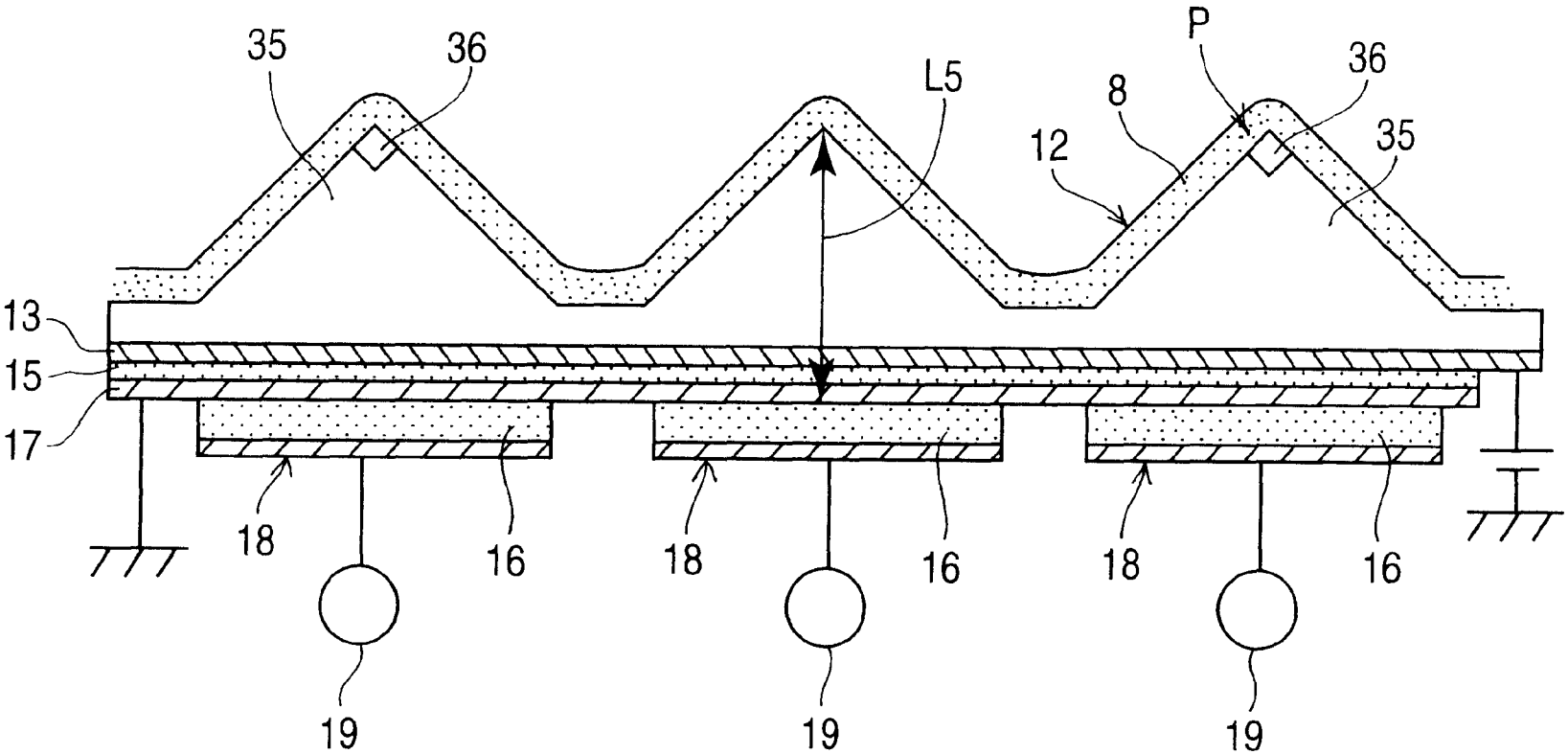
FIG. 6 is a sectional view showing a variation of an jutting eject points employed in the present invention.
Figure 7:
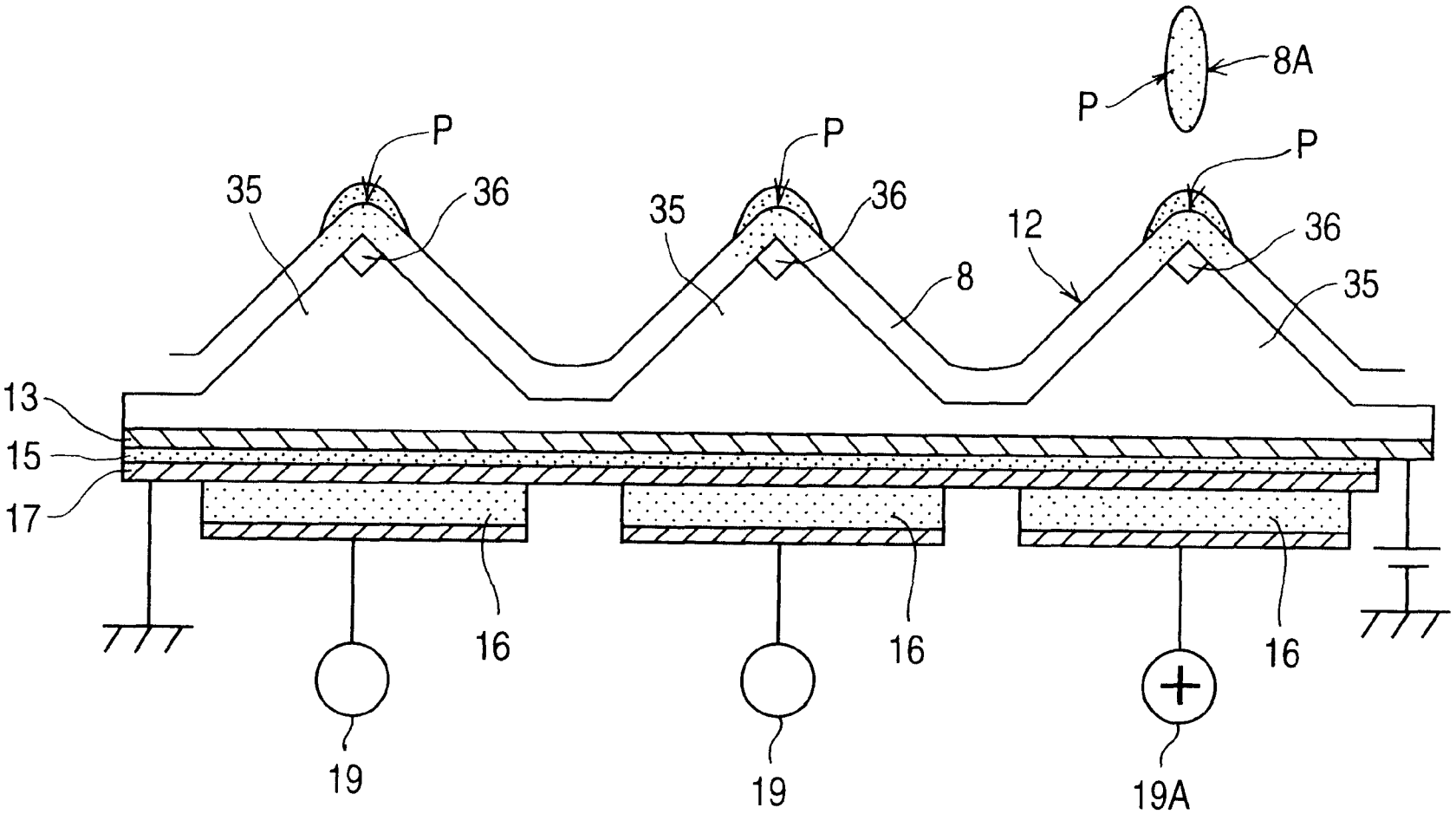
FIG. 7 is a sectional view for explaining an operation of an apparatus shown in FIG. 6.

FIG. 6 is a sectional view showing a variation of a jutting eject point employed in the present invention; and FIG. 7 is a sectional view for explaining an operation of an apparatus shown in FIG. 6.

In the abovementioned embodiment, the top of the respective jutting eject points 4 is made to be a sharply protruding structure, however, the shape thereof is not limited to the embodiment. For instance, a sectional area shape of a top 36 of a jutting eject point 35 may be made to be approximately rectangular (90°) as shown in FIGS. 6 and 7.

The shape of the jutting eject point 35 is made to have a cone or a pyramid. And, a distance L5 between the top 36 and the ultrasonic wave generating section 16 is determined to be an integral multiple of a half wavelength of the ultrasonic wave generating signal applied to the ultrasonic wave generating section 16. The half wavelength corresponds to that of the ultrasonic wave traveling through the jutting eject point 35.

Further, in FIGS. 6, 7, there are provided no lands, however, it is possible to provide the lands as mentioned in the foregoing. Further, in FIGS. 6, 7, only the main structure is shown, however, other constituting components are provided in the same manner as mention in the foregoing.

Figure 8:
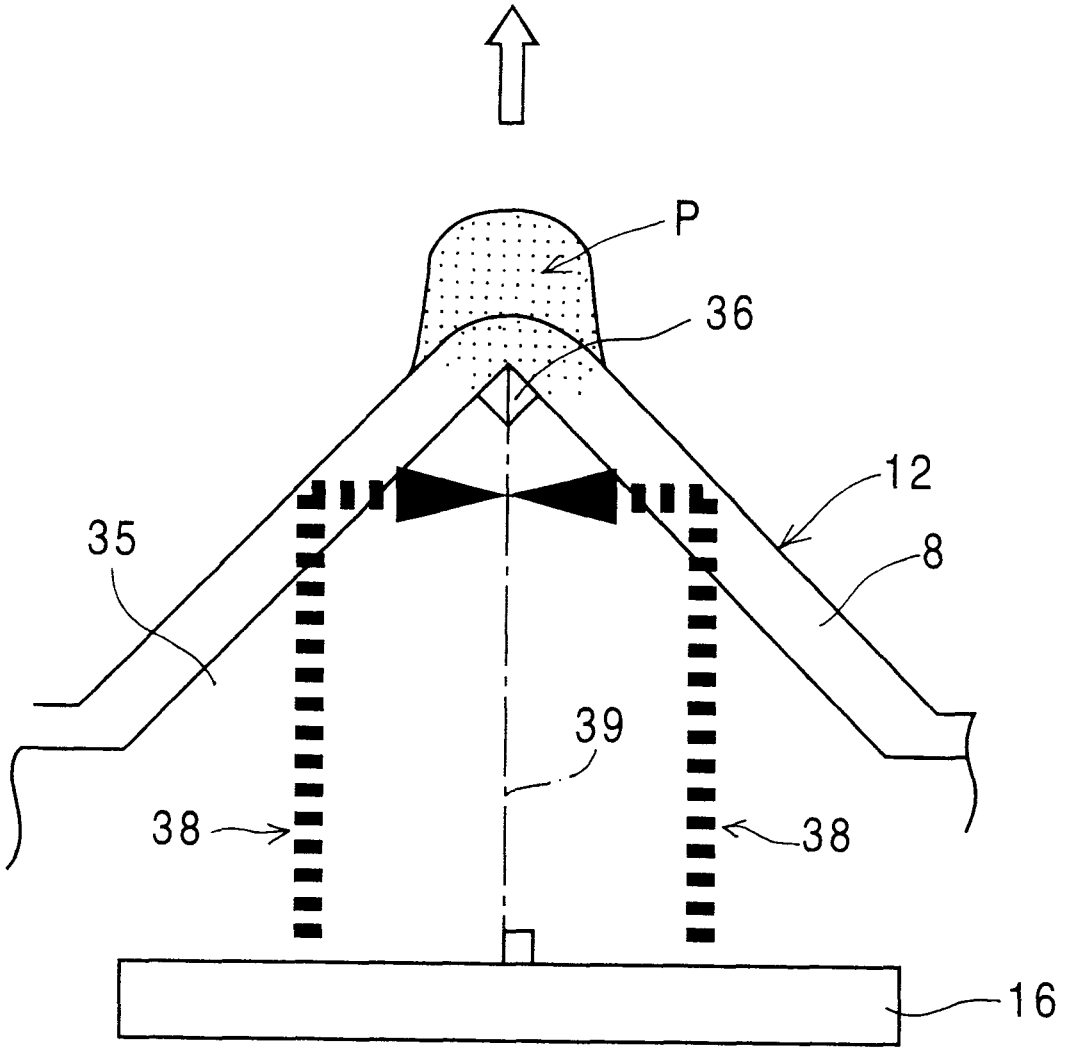
FIG. 8 is a partially enlarged view of FIG. 7.

FIG. 8 is a partially enlarged view of the apparatus shown in FIG. 7.

As a sectional area shape of the top 36 of the jutting eject point 35 is made to be an isosceles triangle having a right angle, the respective ultrasonic waves 38, 38 generated from the ultrasonic wave generating section 16 are reflected in an opposite direction to each other by the surface of the liquid toner drenching slopes of the jutting eject point 35, and the respective ultrasonic waves 38, 38 reflected by the surface thereof meet on a perpendicular line 39 extended from the top 36 as shown in FIG. 8. The respective ultrasonic waves 38, 38 reflected further travel straight across the line 39, and are reflected downward by the opposite slopes respectively, and return to an upper surface of the ultrasonic wave generating section 16. Thus, there is developed a standing wave of the ultrasonic wave in the jutting eject point 35.

On the perpendicular line 39 there is formed an antinode of a vibration, so that a large amount of vibration energy is accumulated thereat. This vibration energy is large enough to separate the liquid droplet agglomerated at the top 36 therefrom, resulting in an effective ejection of the liquid droplet.

Particularly, when the jutting eject point 35 is made by plastic molding so as to have a circular cone with a vertical angle of 90 degree in a section, all the ultrasonic waves generated travel across a center line of the circular cone, resulting in that a resonance energy on the center line becomes extremely large. This enables to eject the liquid droplet more effectively.

Needless to say, dimensions disclosed in the present invention are not limited to ones disclosed in these embodiments.

According to an electrostatic ink-jet printer in the present invention, it has advantages as follows.

It is possible to perform a precise print on various kinds of recording medium like as a high absorptive recording paper and a low absorptive recording paper because the electrified colored particles are agglomerated at the top of the jutting eject point by a bias voltage, and is separated from the top thereof by vibrating the crest of the meniscus of the ink, and the separated electrified colored particles are ejected by being accelerated with the bias electric field. Especially, as the pigment having higher viscosity and less ink permeation than the dye can be used as ink material in the liquid toner, a picture quality can be extremely enhanced.

Further, as the electrified colored particles agglomerated are ejected by an acceleration of the bias voltage, it is possible to set the recording medium remote form the ejecting points, resulting in a low cost printer device requiring no critical adjustment in an assembly process of the jutting eject point.

Further, as there is required neither precise acoustic lens element for converging the ultrasonic wave nor an adjustment of precise distance between the liquid toner surface and the ultrasonic wave generating section, it is possible to realize a simple structure with a low production cost. In addition, as there is required no convergence of the ultrasonic wave, the printer of the present invention requires neither ultra short wavelength (10 $\mu$m) nor a high frequency (150 MHz), which are required in an ultrasonic wave used in the prior art. In the present invention, the frequency of the ultrasonic wave is less than 10 MHz, resulting in an easy production and a low production cost compared with those of the prior art.

Further, different from a liquid toner jet method, there is required no high voltage (about 300 V to 900 V) for developing an electric field for separating the electrified colored particles. The ultrasonic wave generating section can be driven with comparatively lower voltage (less than 10 to 16 volts), resulting in that a drive controlling circuit for the jutting eject point has a simple structure and a low production cost.

Further, as a sectional area shape of the top of the jutting eject point is made to be about a right angle, and a distance between the top thereof and the ultrasonic wave generating section are specified so as to form a standing wave in the jutting eject point in such a manner that an ejection point resides on an antinode of the vibration, a resonance energy on the ejection point can be made large, resulting in an effective separation of the liquid droplet with a less ultrasonic wave output.

Second Embodiment

Next, a description is given of a second embodiment of an electrostatic type ink-jet printer (referred to as ink-jet printer) in the present invention, referring to FIGS. 9 to 17.

Figure 9:
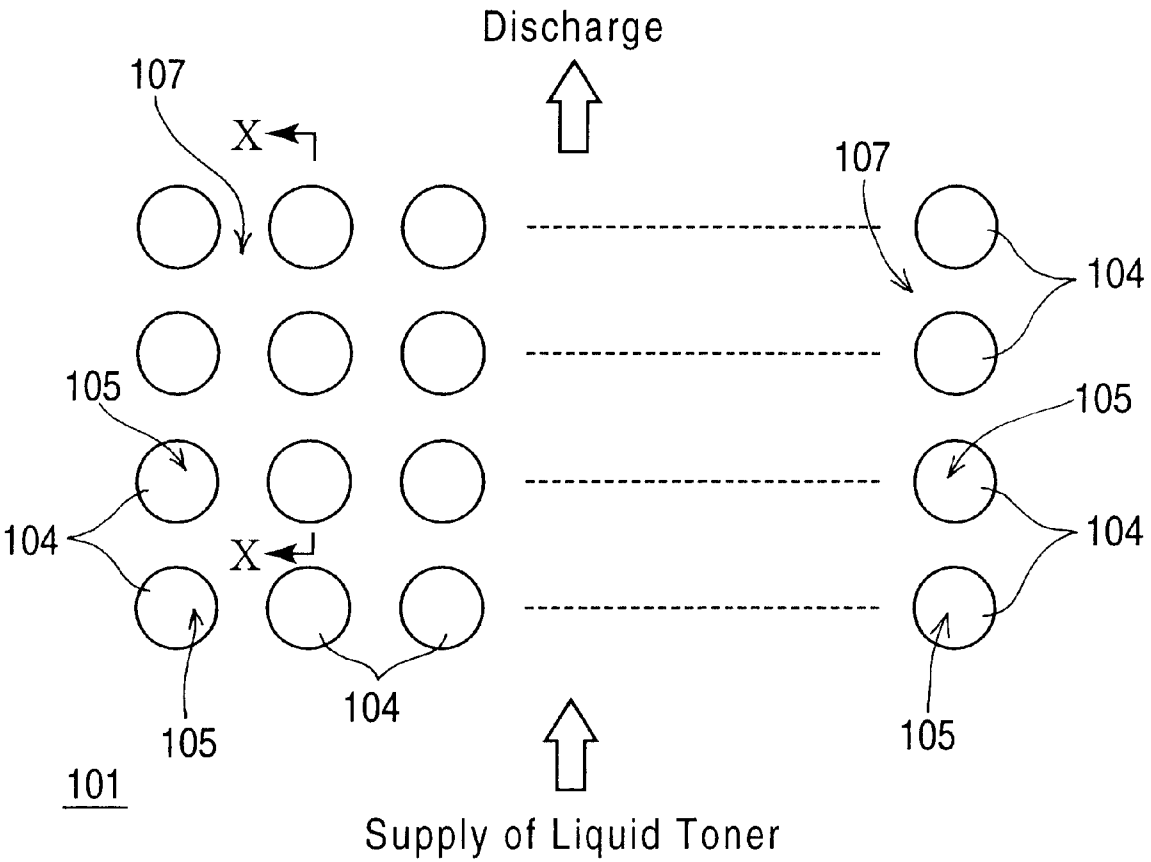
FIG. 9 is a plan view showing a second embodiment of an ink-jet printer of the present invention.
Figure 10:
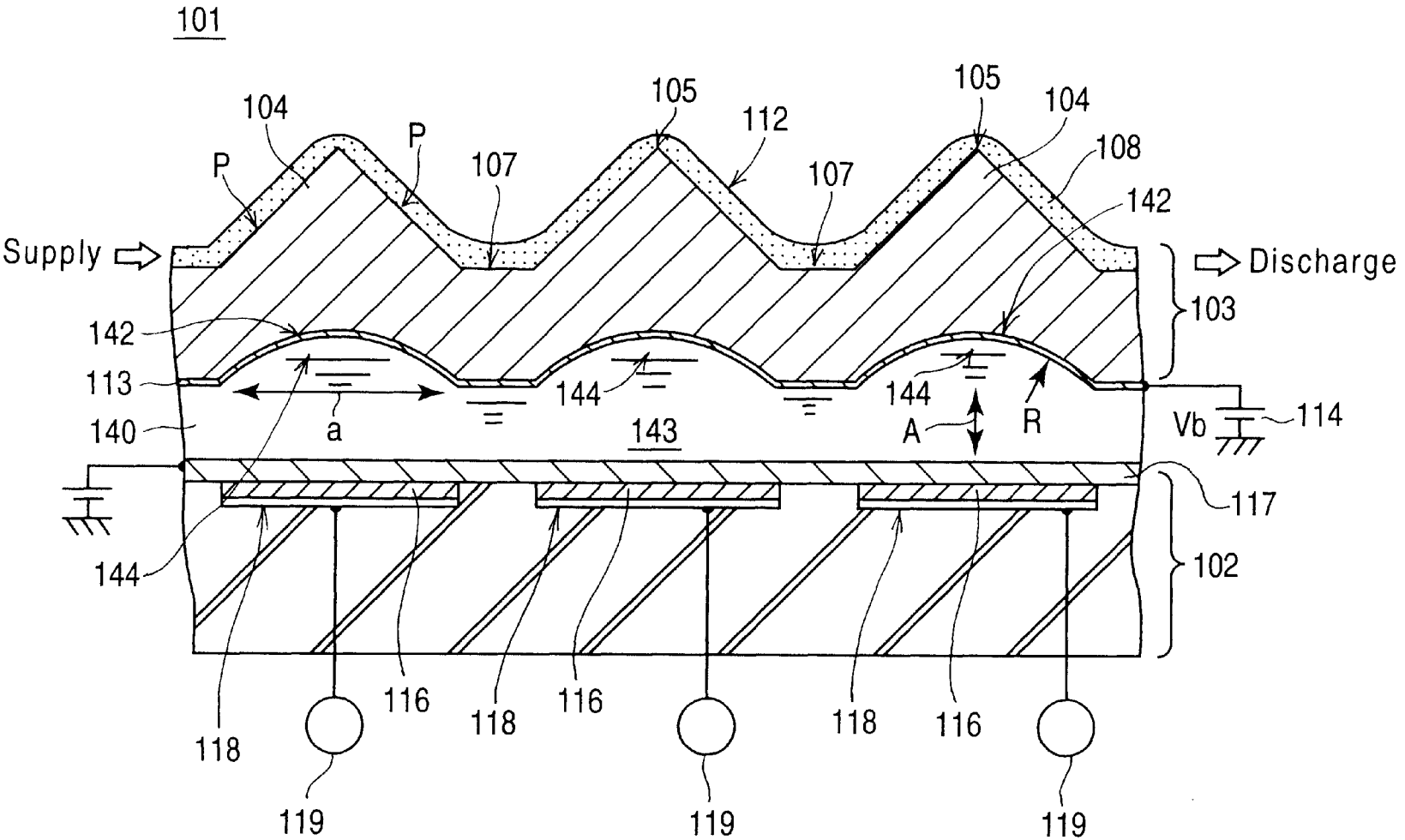
FIG. 10 is an enlarged sectional view along a X—X line shown in FIG. 9.
Figure 11:
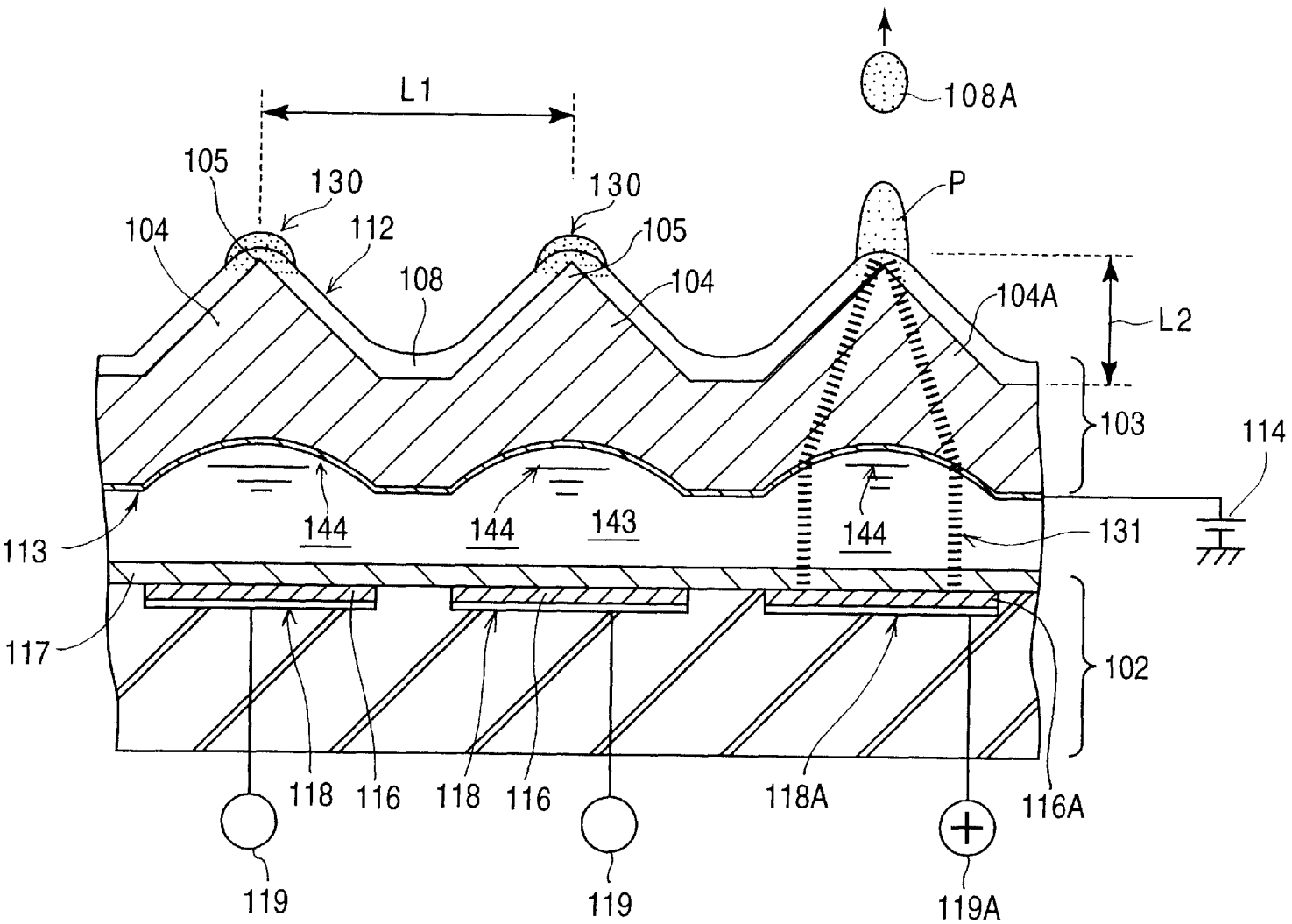
FIG. 11 is a sectional view for explaining an operation of the ink-jet printer shown in FIG. 9.

FIG. 9 is a plan view showing an ink-jet printer of a second embodiment of the present invention;

FIG. 10 is an enlarged sectional view along an X—X line shown in FIG. 9; and FIG. 11 is a sectional view for explaining an operation of the ink-jet printer shown in FIG. 9.

As shown in FIGS. 9 and 10, an ink-jet printer 101 has a substrate section 102 for providing ultrasonic wave generating sections thereon as mentioned hereinafter, and an ejecting plate 103 connected to the substrate section 102 provided with a predetermined clearance 140 therebetween. The ejecting plate 103 is made of a dielectric material such as a thermal plastic by an injection mold.

On the ejecting plate 103, there are orderly and crosswise aligned a plurality of jutting eject points 104 at an equal pitch. Here, the respective jutting eject points 104 have a shape of a circular cone. But, a frustum of a cone with a flat top, a cone with a top 105 of a round top and a frustum of a quadragular pyramid may be employed instead of the circular cone.

Clearances between respective bases of the jutting eject points 104 are made to be a minute distance and all the clearances are connected, resulting in a canal 107. In the canal 107, there is filled a liquid toner 108 containing electrified colored particles dispersed in an insulation liquid such as isoparaffin so that the liquid toner 108 is supplied to the respective jutting eject points through the canal 107 by making use of a capillary phenomenon.

On the ejecting plate 103, fresh liquid toner 108 is supplied from one direction, and used liquid toner 108 is drained to another direction. Thus, the liquid toner 108 is circulated for use in the apparatus.

As mentioned above, by supplying the liquid toner 108 on the surfaces of the jutting eject points 104, the surfaces of the respective jutting eject points 104 are drenched with the liquid toner 108 due to the capillary phenomenon. As a result, a meniscus 112 having crests and troughs is formed over a whole surface of the jutting eject points 104 due to a surface tension.

Further, on a bottom of the ejecting plate 103 corresponding to the respective jutting eject points 104, there are formed hollows with a curved surface 142 having a predetermined radius R. A predetermined clearance 140 formed between the bottom of the ejecting plate 103 and the substrate section 102 is filled with a lens forming liquid 143 to form an ultrasonic convergent lens 144. And, an ultrasonic wave generated from an aforementioned ultrasonic wave generating section 116 is converged close to the top 105 of the jutting eject point 104 by the ultrasonic convergent lens 144 making use of a traveling speed difference of the ultrasonic wave between in the lens forming liquid 143 and in the ejecting plate 103.

On the whole bottom of the ejecting plate 103, there is provided a thin bias electrode 113 made of, for instance, a copper foil (film). To this bias electrode 113, a bias power source 114 is connected so as to apply a DC bias voltage having the same electric polarity as that of the electrified colored particles. By applying the bias voltage an electric field is generated upward in FIG. 10. Thus, the electrified colored particles in the liquid toner 108 are moved to the top 105 of the jutting eject point 104 by the Coulomb force, resulting in an agglomeration of the electrified colored particles at the top 105 of the respective jutting eject points 104 as shown in FIGS. 10 and 11.

On the other hand, on the substrate section 102, there are individually provided ultrasonic wave generating sections 116 corresponding to the respective jutting eject points 104. The respective ultrasonic wave generating sections 116 are composed of a piezoelectric ceramics such as PZT or a barium titanate. Thus, the ultrasonic wave generating section 116 mechanically vibrates at a high frequency being applied with a voltage thereto, resulting in a generation of the ultrasonic wave toward the top 105 of the jutting eject point 104. As shown in FIG. 10, the upper surfaces of the respective ultrasonic wave generating sections 116 are commonly connected to a common electrode 117, and a bottom of the respective ultrasonic wave generating sections 116 is provided with an individual electrode 118 which is connected to a terminal 119. Through the terminal 119, an ultrasonic wave generating signal as a driving signal is applied. Thereby, electrified colored particles agglomerated at the top 105 of the jutting eject point 104 are separable from the top 105 thereof.

The dimensions of the respective components in this embodiment are as follows: a pitch L1 between the respective jutting eject points 104 is 0.5 to 1.0 mm, a height L2 of the respective jutting eject points 104 is 0.2 to 1.0 mm, and a diameter of the respective lenses 144 is 0.51 to 1.4 mm. Thereby, for instance, an image density of 600 DPI (dot per inch) is possible to be formed.

Next, the description is given of an operation of this embodiment.

First, as shown in FIG. 11, the liquid toner 108 is supplied to the ejecting plate 103. The liquid toner 108 is fed through the canal 107 (FIG. 10) by the capillary phenomenon to drench the whole surfaces of the respective jutting eject points 104. The used liquid toner 108 is recovered by being drained in an opposite direction of the supply of the liquid toner 108. Thus, the liquid toner 108 is circularly used. The liquid toner 108 drenching the surfaces of the respective jutting eject points 104 forms the meniscus 112 having crests and troughs caused by a surface tension of the solvent as shown in FIG. 10.

Here, when a voltage is not applied to the bias electrode 113, the electrified colored particles P are not agglomerated to the crests of the meniscus 112, resulting in no expansion in the crests of the meniscus 112. And, when a voltage is applied to the bias electrode 113, an electric field is generated, so that the electrified colored particles P having the same electric polarity as that of the voltage are moved far away from the bias electrode 113, resulting in that the crests of the meniscus 112 are expanded because of the agglomeration of the electrified colored particles P at the crests of the meniscus 112.

Here, when an ultrasonic wave generating signal is applied to a certain individual electrode 118A through a terminal 119A selected from the plural terminals 119, the corresponding ultrasonic wave generating section 116A vibrates in directions shown with a double headed arrow A in FIG. 10, so that an ultrasonic wave 131 generated travels toward the top 10 of the jutting eject point 104A. As the ultrasonic wave generated is converged to the top 105 of the jutting eject point 104A by the ultrasonic convergent lens 144, a vibration power of the ultrasonic wave is intensified. By this vibration energy, a balance maintaining the electrified colored particles caused by the surface tension is broken, so that the crest of the meniscus 112 is expanded by the Coulomb force exerting between the electrified colored particles. Thus, the electrified colored particles agglomerated are separated, resulting in a generation of a liquid droplet 108A. As the liquid droplet 108A electrified is released from the surface tension, it is ejected upward in FIG. 11 by being accelerated by the bias electric field. This liquid droplet 108A attaches on a recording medium (not shown), resulting in a print of characters or an image.

Figure 12A:
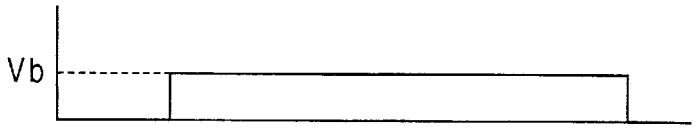
FIG. 12(A) is a waveform of a bias voltage applied to a bias electrode.
Figure 12B:
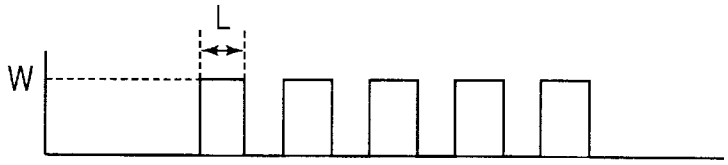
FIG. 12(B) is a waveform of an ultrasonic wave generating signal applied to an individual electrode.
Figure 12C:
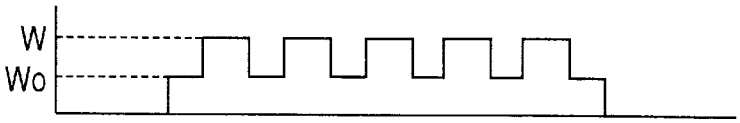
FIG. 12(C) is a waveform of another ultrasonic wave generating signal applied to the individual electrode.
Figure 13A:
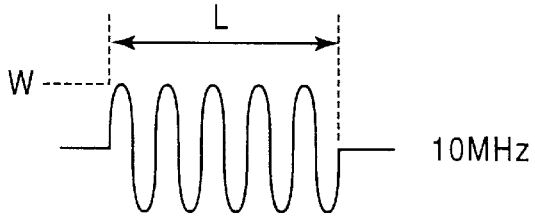
FIG. 13(A) is a detailed waveform of the ultrasonic wave generating signal shown in FIG. 12(B)
Figure 13B:
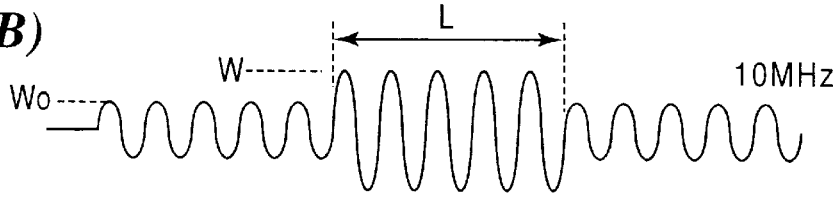
FIG. 13(B) is a detailed waveform of the ultrasonic wave generating signal shown in FIG. 12(C)

FIG. 12(A) is a waveform of a bias voltage applied to a bias electrtode;

FIG. 12(B) is a waveform of an ultrasonic wave generating signal applied to an individual electrode;

FIG. 12(C) is a waveform of another ultrasonic wave generating signal applied to the individual electrode;

FIG. 13(A) is a detailed waveform of the ultrasonic wave generating signal shown in FIG. 12(B); and FIG. 13(B) is a detailed waveform of the ultrasonic wave generating signal shown in FIG. 12(C).

At that time, an ultrasonic wave generating signal applied to the individual electrode 118A is shown in FIGS. 12(B) and 13(A). For instance, a high frequency burst signal of 10 MHz with a power W is used. The liquid droplet 108A is generated by using a high amplitude of the high frequency burst signal, and a print density is varied by changing a length of the high frequency burst signal.

FIG. 12(A) shows a waveform of a bias voltage applied to the bias electrode 113.

The bias voltage Vb is always applied to the bias electrode 113 during the operation.

Further, instead of the ultrasonic wave generating signal shown in FIGS. 12(B) and 13(A), one shown in FIGS. 12(C) and 13(B) may be used. In this case, upon developing the liquid droplet 108A, there is applied an ultrasonic wave generating signal having the same electric power W as that shown in FIGS. 12(C) and 13(B). And in a case other than that, the liquid droplet 108A is prevented from ejecting by applying a signal of an electric power Wo with a smaller amplitude. Thereby, it is possible to agglomerate the electrified colored particles P in a high speed by the Coulomb force during a pulse interval, resulting in a reduction of an interval of the ejection. This reason is considered that the ultrasonic wave releases the boundary force between the solvent and the color particles and decreases frictions exerted between the electrified colored particles P in the liquid toner 108.

As mentioned above, the ultrasonic wave is used for forming the liquid droplet 108A by causing the agglomerated electrified colored particles P to separate from the meniscus 112, and the bias voltage is used for agglomerating the electrified colored particles P in the liquid toner 108 and ejecting the liquid droplet 108A to a recording medium. Thereby, it is possible to effectively form liquid droplets 108A from the liquid toner 108, resulting in print characters and images on the recording medium.

As mentioned above, as the liquid droplets 108A are effectively formed, it is possible to use pigment ink having a higher viscosity than that of a dye, resulting in an image having a high quality without a permeation of ink into a recording medium.

Further, as the generated ultrasonic wave is forcibly and gradually converged toward the top of the jutting eject point 104 by the ultrasonic convergent lens 144, it is possible to increase the ultrasonic vibration power. Thus, not only the utilization efficiency of the ultrasonic wave is enhanced but also the design of the apparatus is simplified because a design of the ultrasonic wave generating section 116 does not require so high dimensional accuracy compared with that in the prior art.

Further, as a subsidiary advantage of the ultrasonic wave which vibrates the electrified colored particles in the liquid toner 108, a movement of the liquid toner 108 in the canal 107 and a agglomeration of the electrified colored particles in the meniscus 112 are smoothly performed, resulting in an easy ejection at a higher frequency.

Here, the convergent effectiveness of the ultrasonic convergent lens 144 is verified by using concrete numerical values.

Figure 14:
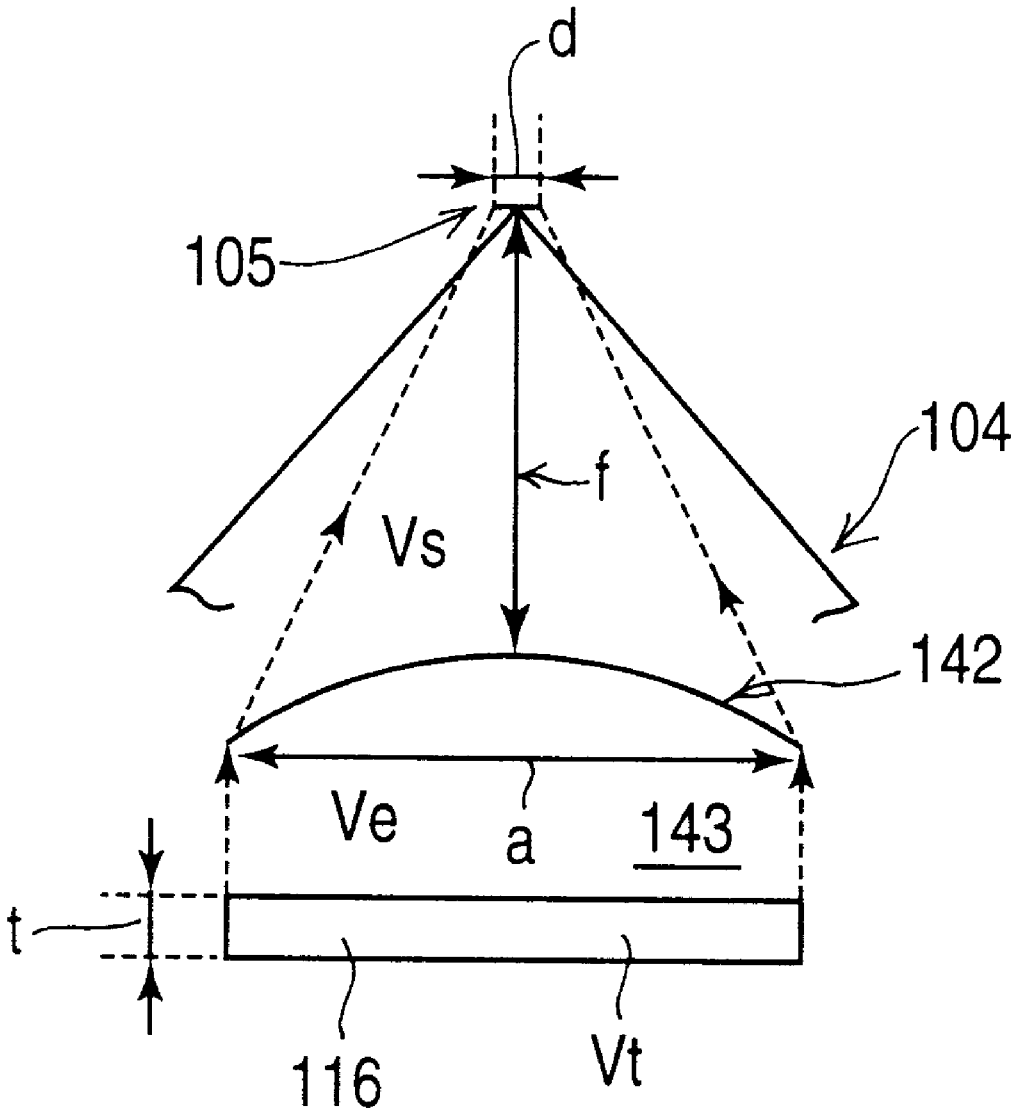
FIG. 14 is a schematic view of a model for explaining an effectiveness of the ultrasonic convergent lens, wherein the model corresponds to one of the jutting eject points shown in FIGS. 10 and 11.

FIG. 14 is a schematic view of a model for explaining a convergent effectiveness of the ultrasonic convergent lens, wherein the model corresponds to one of the jutting eject points 104 shown in FIGS. 10 and 11.

A diameter d of a focus area nearby the top 105 of the jutting eject point 104 is represented by an equation (1).

$$d=1.2\lambda(a/f) \quad (1)$$

Wherein, A: a wavelength of the ultrasonic wave, a: a bore size of a convergent lens 144, and f: a focal length.

Here, the wavelength $\lambda$ is represented by a formula (2) when the resonance frequency is adopted.

$$\lambda=2t\times Vs/Vt \quad (2)$$

Wherein, t: a thickness of the ultrasonic wave generating section 116, Vs: a velocity of sound in the jutting eject point 104, and Vt: velocity of sound in the ultrasonic wave generating section 116.

Further, the focal length f is represented by a formula (3).

$$f=R\times Ve/(Vs-Ve) \quad (3)$$

Wherein, R: a radius of lens curved surface 142, Ve: a velocity of sound in the lens forming liquid 143.

In the abovementioned formulas, when water is used as the lens forming liquid 143, and polystyrene is used as a material of the jutting eject point 104, and values of the respective parameters are established as follows: R=1 mm, f=1.7 mm, t=0.2 mm, $\lambda$=0.24 mm, and a=1.4 mm, a value of the diameter d is obtained as d=0.35 mm.

Thus, a ratio of an area of the convergent lens and an area of the focal point is expressed as $(a/d)^2=16$. This enables to obtain about 16 times as much as the power density of the ultrasonic wave by converging the originally generated power of the ultrasonic wave.

In the above embodiment, an explanation is given of an example where water is used as the lens forming liquid 143.

However, it is not limited to water but other liquids are applicable, for instance, the liquid toner.

Figure 15:
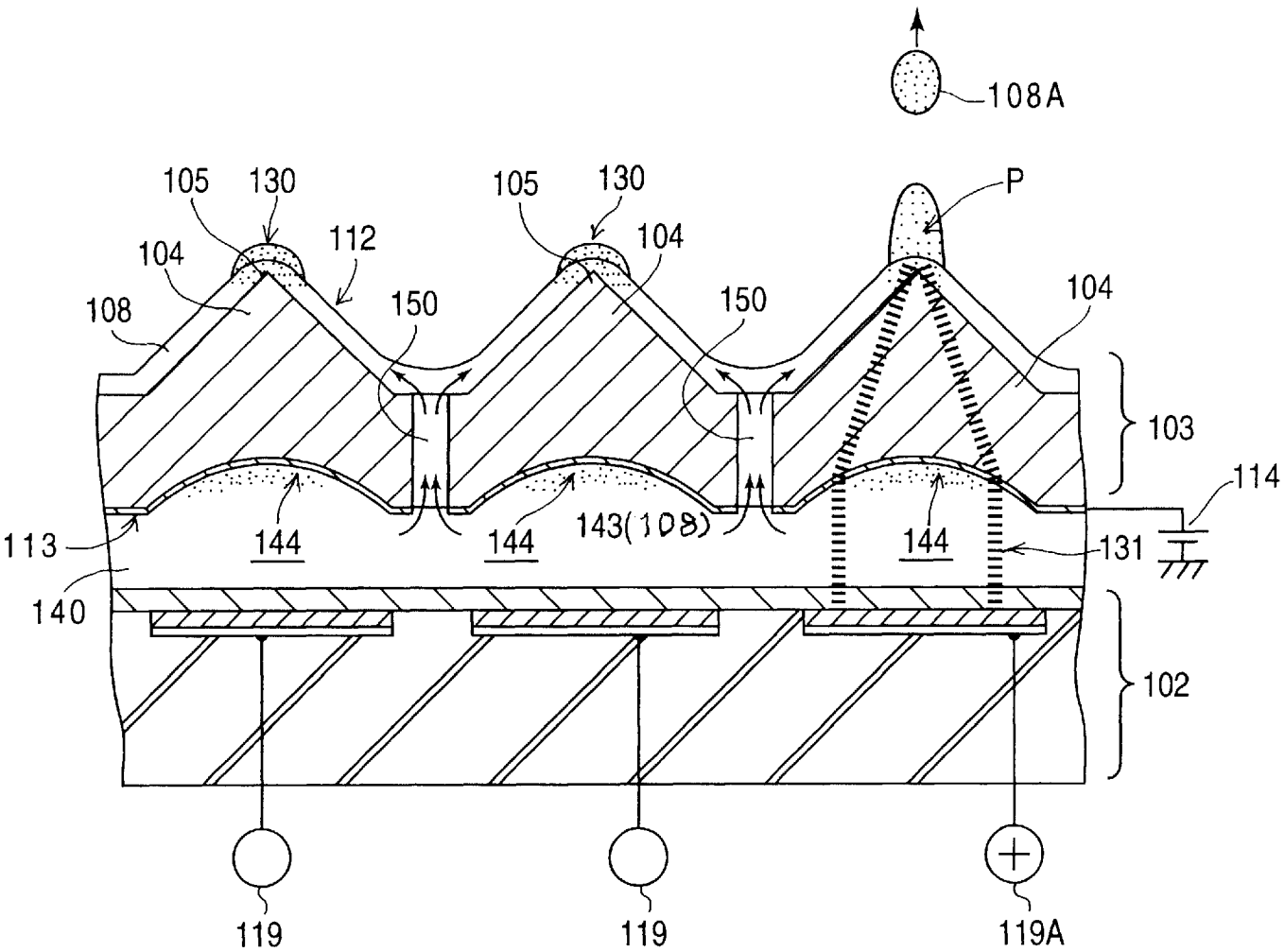
FIG. 15 is a sectional view showing a printer device employing a liquid toner as a lens forming liquid.

FIG. 15 is a sectional view showing a printer device employing a liquid toner as a lens forming liquid.

As shown in FIG. 15, in this embodiment, connecting channels 150 are formed between the respective jutting eject points 104 in the ejecting plate 103 to allow an upper surface of the respective jutting eject points 104 to communicate with the clearance 140.

In the clearance 140, there is filled the liquid toner 108 as the lens forming liquid 143. In this embodiment, the liquid toner 108 supplied to the clearance 140 flows through the respective connecting channels 150, so that it is supplied to the surfaces of the jutting eject points 104.

As a solvent of the liquid toner 108, isoparaffin is typically used. In this case, the construction of the apparatus can be comparably simplified because of omission of water. Further, owing to an effect of the bias electric field, a flow of the electrified colored particles through the connecting channel 150 is promoted. Needless to say, the dimensions of the respective components are established so that the focal point of the lens operation comes to be close to the top 105 of the jutting eject point 104 even when the liquid toner 108 is used as the lens forming liquid 143.

Further, in this embodiment, in order to form the ultrasonic convergent lens 144, the boundary surface between the lens forming liquid 143 and the jutting eject point 104 are formed to be a curved surface, however, it is not limited to this embodiment. For instance, diffraction grating may be used as shown in FIGS. 16 and 17.

Figure 16:
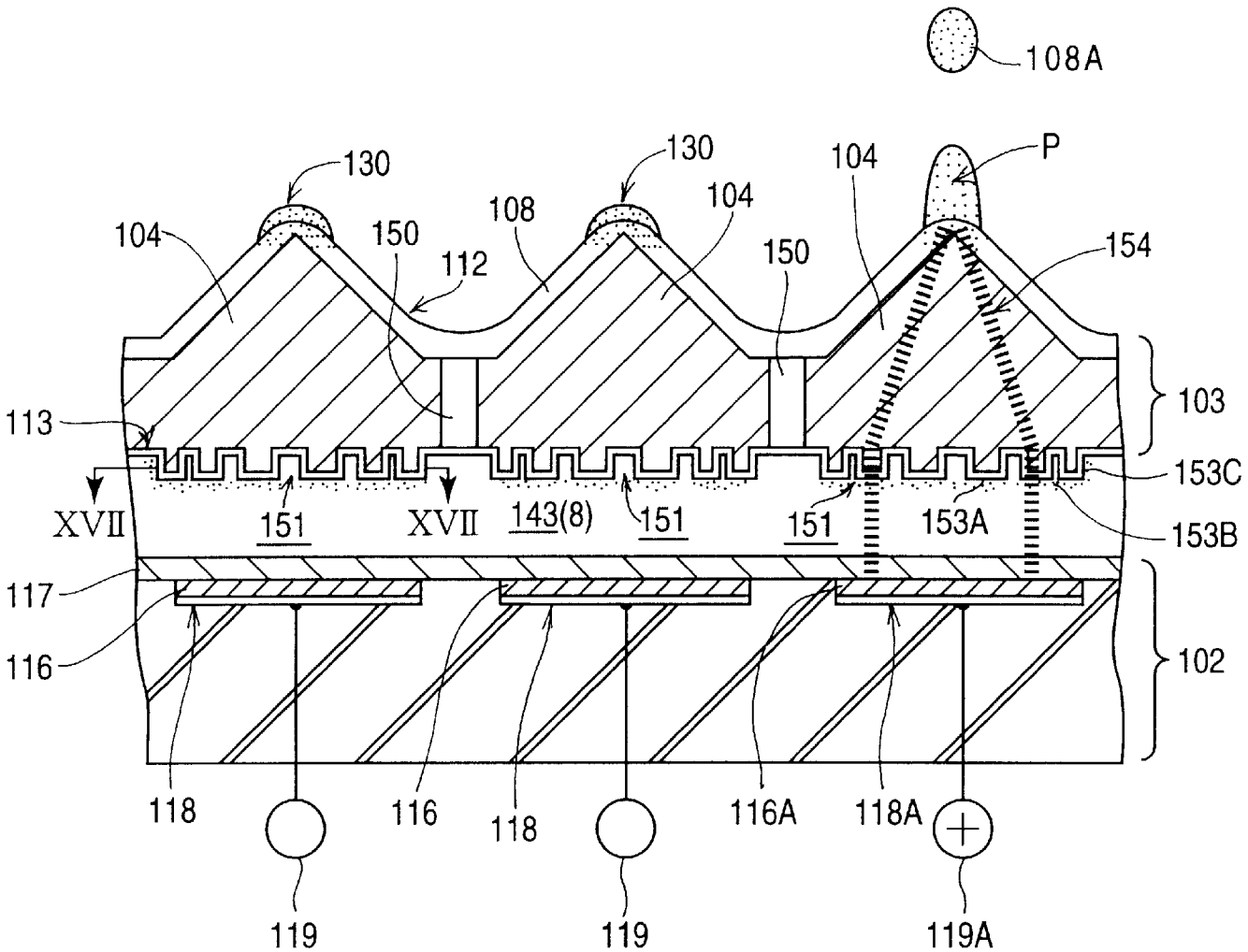
FIG. 16 is a sectional view showing a third embodiment of the present invention.
Figure 17:
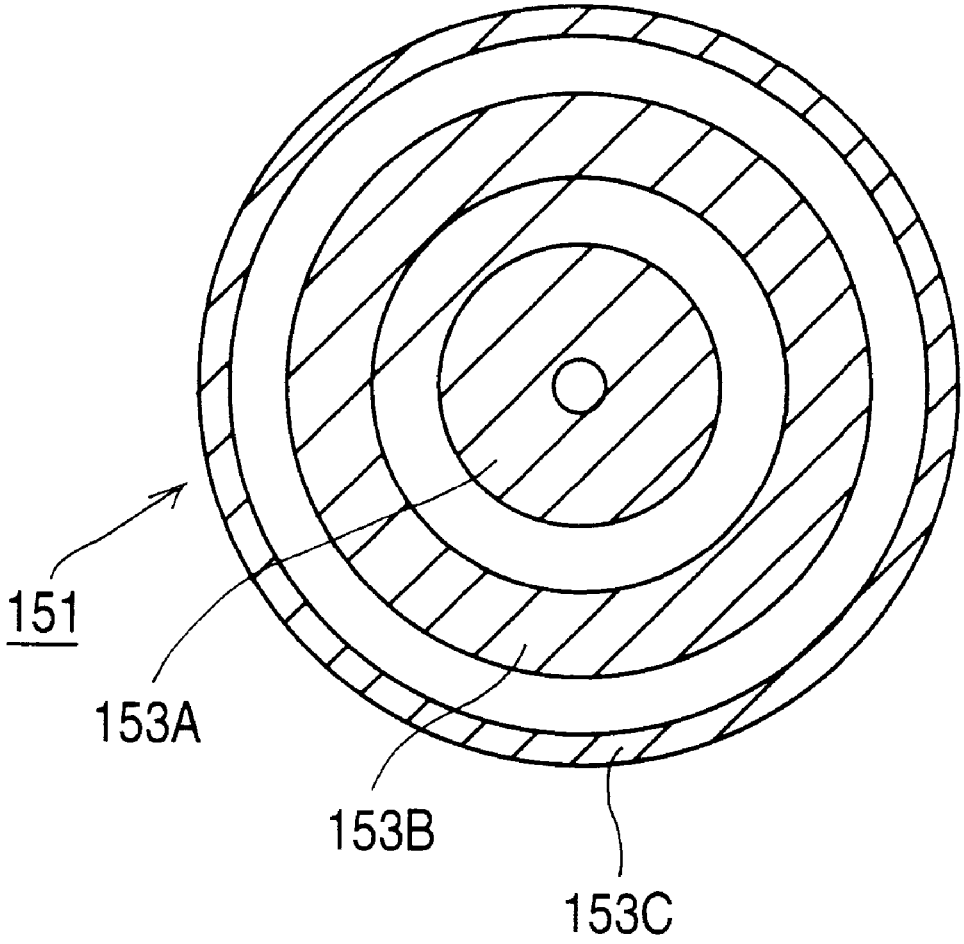
FIG. 17 is a sectional view of a diffraction grating along a X VII—X VII line in FIG. 16.

FIG. 16 is a sectional view showing a third embodiment of the present invention; and FIG. 17 is a sectional view of a diffraction grating cut along a X VII—X VII line in FIG. 16.

As shown in FIGS. 16 and 17, here, a diffraction grating 152 is used as a convergent lens 151. The diffracting grating 152 has a plurality of ring plates 153A, 153B, 153C coaxially aligned in concavity or convexity. These ring plates 153A, 153B, 153C may be integrally formed together with the ejecting plate 103 by injection molding. In FIG. 17, hatched sections designate portions protruding downward in FIG. 16.

In this case, a grating constant is selected so that the primary diffraction of the ultrasonic wave 154 is converged to a portion nearby the top 105 of the jutting eject point 104, resulting in the same effectiveness as that of the first embodiment.

Needless to say, the respective dimensions shown in the above embodiments are only one example. Thus, they are not limited to those of the embodiments.

As explained above, according to the electrostatic ink-jet printer of the present invention, it has excellent functions and advantages as follows.

As print characters and images are formed by agglomerating the electrified colored particles to a top of a jutting eject point under a bias electric field, and separating the agglomerated electrified colored particles by vibrating crests of the meniscus formed on the jutting eject point driven by the ultrasonic wave, and ejecting the electrified colored particles separated by accelerating them under the bias electric field, it is possible to perform a fine print without ink permeation on various kinds of recording medium such as an absorbing paper or an non-absorbing paper.

Further, as the ejection of the agglomerated electrified colored particles are accelerated under the bias electric field, it is possible to place the recording medium remote from the jutting eject point. Thus, there is not required a precise assembly adjustment in an assembly of an ejection head, resulting in an electrostatic ink-jet printer having a low production cost.

Further, as the ultrasonic wave is effectively converged by a convergent lens, an ultrasonic vibration power is enhanced, resulting in a reduction of print energy.

Further, different from an ultrasonic ink-jet method of the prior art, a size of the liquid droplet in the present invention is not determined by a diameter of a focal zone.

Therefore, a high accuracy is not required in a frequency of the ultrasonic wave and the convergent lens, resulting in an easy design without a critical control of a height of the liquid toner surface in a degree of several $\mu$m.

Further, the control of the liquid droplet to be ejected from the respective jutting eject point is performed by the ultrasonic wave. Unlike an electric field, the ultrasonic wave does not diverge electric field, therefore, a closs-talk to an adjacent ejection point is extremely limited.

Further, as a bias electric field for agglomerating the electrified colored particles is fixed, it is possible to apply a relatively high bias voltage. This enables to design the bias electrode to be placed apart from the top of the jutting eject point. Thus, a degree of freedom of a design or a production method for the jutting eject point plate is increased. This enables to utilize an injection molding which require a relatively large mass, resulting in an ejection head of the electrostatic type ink-jet printer having a low production cost.

What is claimed is:

1. An electrostatic ink-jet printer comprising:

a plurality of jutting eject points made of dielectric material orderly disposed in a plane:

a liquid toner containing electrified colored particles for drenching surfaces of the plurality of jutting eject points;

a bias electrode for generating a coulomb force by being applied with a voltage having an identical electric polarity with that of the electrified colored particles so as to agglomerate the electrified colored particles to tops of the plurality of jutting eject points; and a plurality of ultrasonic wave generating sections provided at positions corresponding to bases of the plurality of jutting eject points, the plurality of ultrasonic wave generating sections generating ultrasonic waves toward the tops of the plurality of jutting eject points so as to separate liquid droplets containing the agglomerated electrified colored particles from the tops thereof, wherein a sectional shape of a top of each of the plurality of jutting eject points is made to be a right angle and a distance between a base of the jutting eject point and the respective plurality of ultrasonic wave generating sections is made to be an integral multiple of a half wavelength of the ultrasonic wave.

2. An electrostatic ink-jet printer comprising:

a plurality of jutting eject points made of dielectric material orderly aligned on a plane;

a liquid toner containing electrified colored particles for drenching surfaces of the plurality of jutting eject points;

a bias electrode for generating a coulomb force by being applied with a voltage having an identical electric polarity with that of the electrified colored particles;

a plurality of ultrasonic wave generating sections provided at positions corresponding to bases of the plurality of jutting eject points, for generating ultrasonic waves travelling toward tops of the plurality of jutting eject points; and an ultrasonic convergent lens for converging the ultrasonic wave to the tops of the plurality of jetting eject points so as to separate liquid droplets containing the agglomerated electrified colored particles from the tops of the plurality of jutting eject points.

3. An electrostatic ink-jet printer as claimed in claim 2, wherein the ultrasonic convergent lens comprises a lens liquid and curved bottoms of the plurality of ultrasonic wave generating sections in such a manner that the lens liquid is provided between the curved bottoms of the plurality of ultrasonic wave generating sections and the plurality of jutting eject points.

4. An electrostatic ink-jet printer as claimed in claim 2, wherein the ultrasonic convergent lens is made of a diffraction grating composed of a plurality of ring plates being coaxially aligned.

5. An electrostatic ink-jet printer as claimed in claim 2, wherein the ultrasonic wave generating section is applied with a high frequency burst signal as an ultrasonic wave generating signal.

6. An electrostatic ink-jet printer as claimed in claim 2, wherein the ultrasonic wave generating section is applied with an ultrasonic wave generating signal including a first high frequency burst signal having a small amplitude for separating the liquid droplets and a second high frequency burst signal having an amplitude larger than the small amplitude for promoting motions of the electrified colored particles.

* * * * *